United States Patent [19]

Zajac

[11] 4,334,614

[45] Jun. 15, 1982

[54] WINDINGS USING WATER-SOLUBLE WIND STABILIZATION SEGMENTS

[75] Inventor: Ronald E. Zajac, Goldens Bridge, N.Y.

[73] Assignee: Windings, Inc., Goldens Bridge, N.Y.

[21] Appl. No.: 197,255

[22] Filed: Oct. 15, 1980

[51] Int. Cl.[3] ..... B65B 11/00; B65B 53/02; B65B 63/04; B65D 85/672

[52] U.S. Cl. ..... 206/389; 206/408; 242/163; 220/DIG. 30; 53/397

[58] Field of Search ..... 206/389, 0.5, 408, 409, 206/410; 53/397; 242/164, 163; 220/DIG. 30

[56] References Cited

U.S. PATENT DOCUMENTS

| | | | |
|---|---|---|---|
| 2,200,721 | 5/1940 | Marinsky et al. . | |
| 2,750,027 | 6/1956 | Cummings | 220/DIG. 30 |
| 3,388,195 | 6/1968 | Christenson . | |
| 3,803,796 | 4/1974 | Newman et al. | 53/397 |
| 3,850,863 | 11/1974 | Clendinning et al. | 220/DIG. 30 |
| 3,892,905 | 7/1975 | Albert | 220/DIG. 30 |
| 4,008,544 | 2/1977 | Rupprecht et al. | 220/DIG. 30 |

*Primary Examiner*—William T. Dixson, Jr.
*Attorney, Agent, or Firm*—Watson, Cole, Grindle & Watson

[57] ABSTRACT

Water-soluble wind stabilization segments are used to stabilize the winding of coils wound in a figure-8 configuration with a radial opening provided on the side of the winding such that the winding may be unwound from the inside out. The water-soluble stabilization segments dissolve when the winding is immersed in water, thereby obviating the need to physically remove such stabilization segments prior to unwinding the wound package.

4 Claims, 5 Drawing Figures

WINDINGS USING WATER-SOLUBLE WIND STABILIZATION SEGMENTS

BACKGROUND OF THE INVENTION

This invention relates to water-soluble wind stabilization segments, and in particular to packages of wound material utilizing such segments to stabilize the windings of coils wound in a figure-8 configuration with a radial opening provided on the side of the winding, whereby the winding may be unwound from the innermost coils first by removing the innermost coils through the radial opening.

The use of stabilization segments to stabilize the winding of a package of wound material in which the material is unwound through a radial opening in the side of the material is well known to those skilled in the art as is evidenced by U.S. Pat. No. 3,803,796. In accordance with the method of packaging as taught by the aforementioned U.S. Patent, segments are utilized to maintain the stability of the winding. However, a significant drawback to such a method of packaging is that when the package is to be used, a supporting cone must be removed such that the segments can be taken out through the opening and then the cone is replaced. The package is then ready for payout.

SUMMARY OF THE INVENTION

In accordance with the method of the invention, a water-soluble substance is used as a wind stabilizing element in packages for oceanographic use. The water-soluble stabilizers dissolve when the package is immersed in water such that there is no need for physical removal of the stabilizers as there is in accordance with prior art packages. Wind packages stabilized in the manner of the invention would remain stabilized during deployment from ships, for example.

The water-soluble stabilization segments are manufactured in accordance with any type of molding that is adaptable to form polyvinyl alcohol, which is a water-soluble compound. The water-soluble stabilization segments could be injection molded, vacuum formed or cast. The actual method of forming the stabilization segments is not a significant aspect of the invention. Those having ordinary skill in the art to which the invention pertains would readily recognize the most expeditious manner of forming the water-soluble stabilization segments. Such water-soluble stabilization segments can be utilized in forming and packaging flexible material in a manner similar to that which is disclosed in U.S. Pat. No. 3,803,796. However, it should be apparent that the scope of this invention is not limited to the specific method of packaging as disclosed in the aforementioned U.S. Patent. The segments may be utilized with or without the use of cones, or with or without the use of shrink-wrap covering as disclosed in the aforementioned U.S. Patent.

The signnificant feature of the invention is the use of water-soluble stabilizing segments in a package of flexible material of the universal type with a radial opening into the central axial opening of the winding through which the inner end of the material is drawn as the material is paid-out.

BRIEF DESCRIPTION OF THE DRAWINGS

In the drawings:

With reference to FIGS. 1 to 3, there is shown a shaft spindle 2 having a split end which can be enlarged as a threaded member, this being of well known type. According to the invention, a tube 4 is slipped into spindle 2 and secured thereon. On tube 4 end members 6 are secured by set screws 8. These end members have surfaces 10 outwardly curved in shape. Between these end members are segments 12 and 14, segments 12 being preferably formed of aluminum and segments 14 are pre-formed, water-soluble members. Each aluminum segment 7 has an annular extent of about 45° and each plastic segment extends approximately 75°. Segments 12 and 14 have a main cylinder portion 16, downwardly or inwardly curved end portions 18 and flat ends 20 extending radially (see FIG. 3). They are held in place by the fact that end members 10 slightly overlap the curved portions 18 as shown at 22 in FIG. 3.

The mandrel so formed is utilized in a winding machine having means to move a guide for the flexible material back and forth along the mandrel slightly out of phase with the rotation of the spindle, while the varying relationship at one or more points in each layer forms a radial opening into the axial opening. This may for example be done as shown in Taylor U.S. Pat. No. 2,767,938, which forms a so-called plus-minus winding, and U.S. Pat. No. 3,666,200.

When the package has reached the outer limit, that is the outer edges of end members 10, winding is stopped, tube 24 is inserted in the radial opening and inner end 26 of the material is drawn out from this tube.

Figure 1:
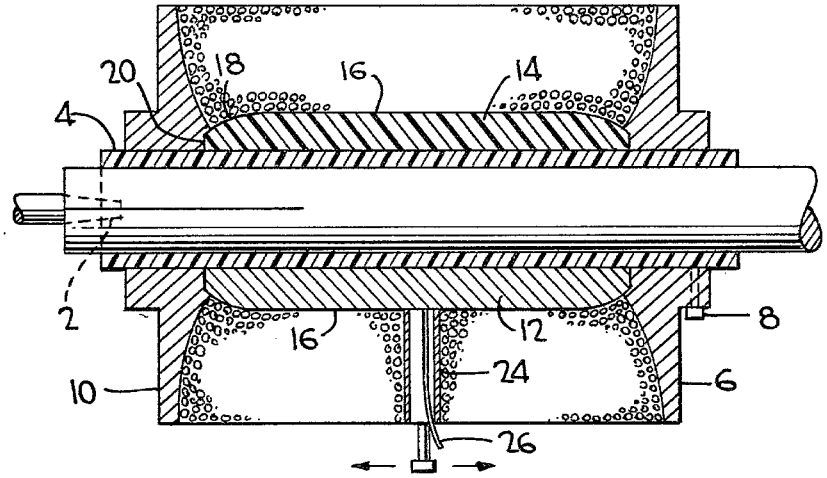
FIG. 1 shows in cross-section a package wound on a spindle in accordance with the invention.
Figure 2:
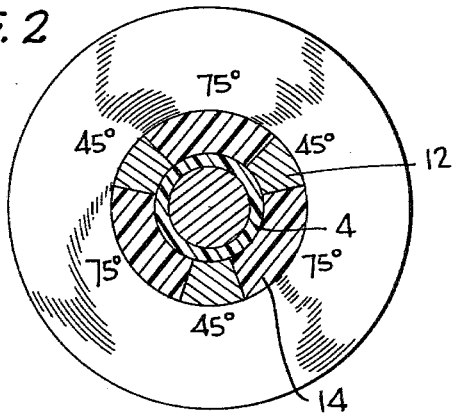
FIG. 2 is a cross-section through the spindle of FIG. 1.
Figure 3:
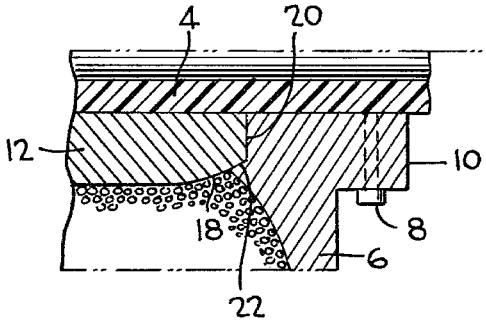
FIG. 3 is an enlargement of a part of FIG. 1.
Figure 4:
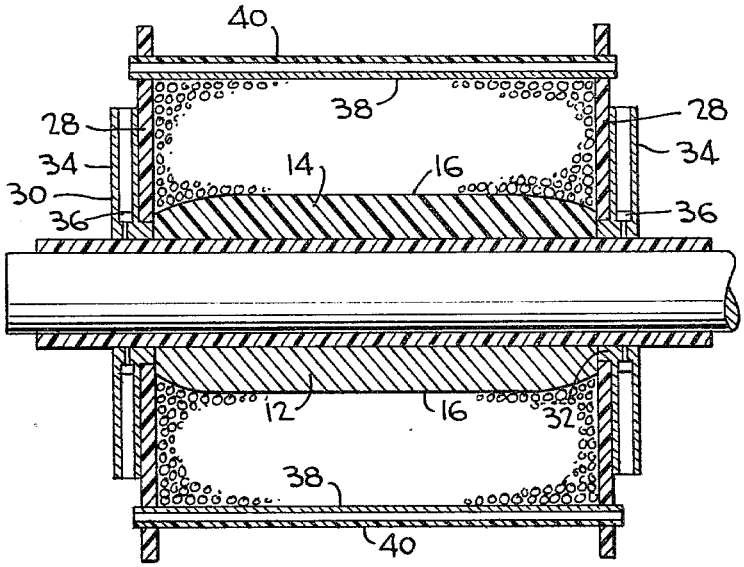
FIG. 4 shows the further procedure according to the invention.

Tube 4 is now released from spindle 2, and the assembled package is moved to another spindle (FIG. 4). Before it is placed on the second spindle, one of the end members 10 is removed and is replaced by annular member 28, preferably of plastic material, and having a central opening therein of slightly less diameter than the outer diameter of the flat ends 20 of the segments, and a backing member 30 which has protruding flange 32 fitting closely within the opening in annular member 28 and an outwardly extending ring portion 34, which can be secured in place by set screw 36. Flange 32 provides proper centering for plastic annular member 28, and backing member 34 keeps the annular plastic member upright. As is shown in FIG. 4, these parts are pushed on until flange 32 abuts against one of end faces 20 of segments 12,14, thus flattening the outwardly curved end wall of the package and placing it in a radial plane.

Tube 4 is now reversed on the spindle, the other end member 10 is removed and is replaced similarly by annular member 28 and backing member 30.

Now the resulting package is wrapped with a layer 38 of corrugated paper or the like, which is enclosed within a tubular member 40 of heat shrinkable plastic. Heat is then applied and the ends of the shrinkwrap 40 are brought around the outer edges of discs 28. At the same time, a hole is maintained through wrappings 38 and 40 through which the inner end of the material is brought out.

The package is now removed from tube 4 by loosening set screws 36 and backing members 30 are removed. Pre-formed water-soluble segments 14 are then secured by metal clips 42 which engage over end discs 28 of the package (FIG. 5), being bent down at the outer ends 44 to rest against the outer edges of disc 28 and which at their end inner ends are bent down at 46 to enter into openings in the ends of segments 14. Metal segments 12 are removed, which can be done through the open end by pressing the adjacent water-soluble segments outwardly.

Figure 5:
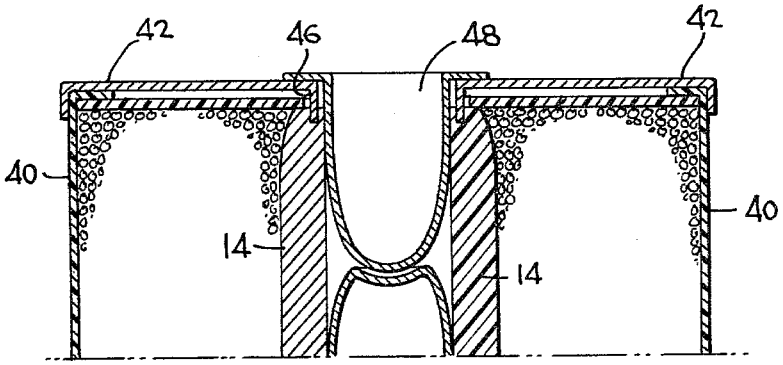
FIG. 5 is a cross-section through a fixed part of a package.

Now there are inserted into the ends of the package a pair of cones 48 of the type shown generally in U.S. Pat. No. 3,689,005. The upper ends of these cones, as shown in FIG. 5, engage the inner walls of segments 14 and thus push them against the inner surface of the wound mandrel.

The package is now ready for shipment. During shipment, the stability of the winding is maintained by the fact that the segments 14 are placed outwardly against its inner surface. When the package is to be used, there is no need to remove segments 14 as they will dissolve when immersed in water where the package is to be paid-out. The shrink-wrap 40 may be removed from the packages prior to immersion in water to enhance the entry of water into the winding to dissolve the water-soluble stabilization segments.

Those skilled in the art will recognize that various modifications of the wound package may be made primarily in dependence upon the characteristics of the material being wound. For example, it may not be necessary to shrink-wrap the package, nor may it be necessary to provide cones 48 which are normally used to prevent bird-nesting as the material is unwound. It is also readily apparent to one of ordinary skill in the winding art that the water-soluble stabilization segments are useful with winding packages wound by methods other than that which is specifically disclosed herein.

What is claimed is:

1. A package of wound material, comprising:

a winding wound in a figure-8 configuration with a radial opening from the side of the winding into the inner axial opening thereof through which the inner end of the material is brought out for unwinding; and water-soluble stabilization segments mounted at spaced intervals along the inside diameter of the winding.

2. The package of wound material as in claim 1 further comprising clips engaging an end of each of said water-soluble stabilization segments and an end of the winding for mounting the stabilization segments within the winding.

3. A package of wound material as in claim 2 further comprising a pair of cones each inserted in opposite ends of the axial opening of the winding.

4. A package of wound material as in any of claims 1, 2 or 3, further comprising a shrink-wrap covering wrapped around the outer coils of said winding.

* * * * *